US006359570B1

(12) United States Patent
Adcox et al.

(10) Patent No.: US 6,359,570 B1
(45) **Date of Patent: *Mar. 19, 2002**

(54) VEHICLE-STATUS DEVICE AND SYSTEM FOR REMOTELY UPDATING AND LOCALLY INDICATING THE STATUS OF A VEHICLE

(75) Inventors: Thomas A. Adcox, Nevada, TX (US); William R. Adcox, Lexington, OK (US); Eric N. Vander Drift, Rowlett, TX (US)

(73) Assignee: Intelligent Vehicle Systems, Inc., Rowlett, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/686,603

(22) Filed: Oct. 11, 2000

Related U.S. Application Data

(63) Continuation-in-part of application No. 09/469,560, filed on Dec. 22, 1999.

(51) Int. Cl.[7] ..... G08G 1/00

(52) U.S. Cl. ..... 340/902; 340/425.5; 340/426; 340/928; 340/905; 340/539; 340/7.21; 340/10.1; 340/10.6; 340/825.69; 340/825.72; 340/286.01; 701/35

(58) Field of Search ..... 340/425.5, 426, 340/928, 902, 901, 904, 905, 988, 989–996, 539, 540, 531, 534, 572.1, 825.33, 825.3, 825.34, 825.36, 825.44, 825.4, 10.1, 10.4, 10.41, 10.42, 10.6, 825.01, 825.72, 826.01; 701/35, 33, 36; 455/517, 422

(56) References Cited

U.S. PATENT DOCUMENTS

| | | | | |
|---|---|---|---|---|
| 5,500,638 A | | 3/1996 | George | 340/468 |
| 5,748,106 A | * | 5/1998 | Schoenian et al. | 340/928 |
| 5,825,283 A | * | 10/1998 | Camhi | 340/438 |
| 5,847,661 A | * | 12/1998 | Ricci | 340/902 |
| 5,917,405 A | | 6/1999 | Joao | 340/426 |
| 5,926,086 A | | 7/1999 | Escareno et al. | 340/426 |
| 5,963,129 A | * | 10/1999 | Warner | 340/468 |
| 6,028,537 A | * | 2/2000 | Suman et al. | 340/988 |
| 6,052,068 A | * | 4/2000 | Price et al. | 340/933 |
| 6,073,062 A | * | 6/2000 | Hoshino et al. | 701/3 |
| 6,121,880 A | * | 9/2000 | Scott et al. | 340/572.5 |
| 6,147,598 A | * | 11/2000 | Murphy et al. | 340/426 |
| 6,154,658 A | * | 11/2000 | Caci | 455/466 |
| 6,163,277 A | * | 12/2000 | Gehlot | 340/905 |
| 6,167,333 A | * | 12/2000 | Gehlot | 701/35 |
| 6,202,023 B1 | * | 3/2001 | Hancock et al. | 701/201 |
| 6,216,053 B1 | * | 4/2001 | Cureton et al. | 700/104 |
| 6,222,463 B1 | * | 4/2001 | Rai | 340/928 |

FOREIGN PATENT DOCUMENTS

| | | |
|---|---|---|
| WO | WO98/43104 | 10/1998 |
| WO | WO99/22353 | 5/1999 |

* cited by examiner

*Primary Examiner*—Nina Tong
(74) *Attorney, Agent, or Firm*—Smith, Danamraj & Youst, P.C.

(57) ABSTRACT

A vehicle status device and system for remotely updating and locally indicating the status of a vehicle. The vehicle status device is located in a vehicle and indicates status information for the vehicle on a vehicle-status indicator on the vehicle when the device is interrogated by an interrogating unit. The device includes a database of status information for the vehicle and owner. An update receiver in the device receives encoded updated information from a wide area paging network for storage in the database. An interrogation receiver receives an interrogation signal from the interrogating unit, and a processor decodes the status information and sends it to the status indicator in response. The system also includes an interrogating unit which includes a police radar transmitter or a laser transmitter for transmitting the interrogation signal to the vehicle status device. The status indicator includes a set of summary status lights and may also include an LCD display for detailed status information. In an alternative embodiment, the device uses a wireless Internet access device to access external databases and download the vehicle status information either periodically or on demand. The information may be passed directly to the status indicator without the need for an internal database.

4 Claims, 9 Drawing Sheets

VEHICLE-STATUS DEVICE AND SYSTEM FOR REMOTELY UPDATING AND LOCALLY INDICATING THE STATUS OF A VEHICLE

RELATED APPLICATIONS

This application is a Continuation-in-Part of co-pending U.S. patent application Ser. No. 09/469,560 entitled, "Apparatus and System for Remotely Updating and Monitoring the Status of a Vehicle", filed Dec. 22, 1999 in the names of Thomas A. Adcox and William R. Adcox.

BACKGROUND OF THE INVENTION

1. Technical Field of the Invention

This invention relates generally to vehicle identification and location devices and, more particularly, to a vehicle-status device and system for remotely updating and locally indicating the status of a vehicle.

2. Description of Related Art

There are millions of cars and trucks operating on the road today. Local, state, and national governments attempt to control the licensing and operation of these vehicles in order to promote public safety and obtain revenue. In addition to the well known requirements for obtaining a driver's license, state governments typically require that an annual registration fee be paid for each vehicle in order to maintain a current license for the vehicle. In addition, most states require that a safety inspection be performed on the vehicle each year by a state-approved inspection station. Many states have also passed laws requiring that drivers maintain a minimum level of liability insurance for each vehicle that they operate. In an effort to enforce these laws, drivers may be required to present proof of insurance for their vehicle at the time that they obtain a safety inspection or renew their registration.

There are still major problems in many states with drivers who do not comply with the above requirements. These drivers may forge vehicle registration stickers, safety inspection stickers, or proof-of-insurance papers. Alternatively, they may purchase insurance long enough to receive proof-of-insurance papers, and then cancel it shortly thereafter. These actions negatively impact public safety and increase the cost of insurance for all of the legitimate vehicle operators in the state.

Law enforcement personnel have an additional problem in identifying stolen vehicles. Some vehicles may be equipped with security systems which broadcast a location for the vehicle if the vehicle is started and/or driven without performing certain security functions. These security systems can assist the police in locating the stolen vehicle. Most vehicles, however, do not have such security systems, and even for ones that do, actual identification of the vehicle is still difficult. The police must visually read the license number and verify this number in their database.

In order to overcome the disadvantage of existing solutions, it would be advantageous to have a vehicle-status device and system for remotely updating and locally indicating the status of a vehicle. Such a device would include an electronic vehicle-status indicator for use by law enforcement personnel to quickly and easily determine the status of any vehicle. The present invention provides such a device and system.

SUMMARY OF THE INVENTION

In one aspect, the present invention is a vehicle status device for displaying status information for a vehicle. The device includes a database of status information for the vehicle; an update receiver that receives updated vehicle information for storage in the database; an interrogation receiver that receives an interrogation signal from an interrogating unit; a vehicle status indicator for indicating the vehicle status information; and a processor that retrieves the vehicle status information from the database and sends the information to the indicator in response to the interrogation receiver receiving the interrogation signal. The vehicle status indicator may include a plurality of summary status indicators that provide a summary of the vehicle status in predetermined areas of interest at a glance, and a display that provides detailed vehicle status information.

In another aspect, the present invention is a vehicle status device for indicating status information for a vehicle and an owner of the vehicle. The device includes a database of status information for the vehicle and the owner, a wide area pager receiver that receives encoded updated vehicle and owner information from a wide area paging network, an interrogation receiver that receives an interrogation signal from the interrogating unit, and a vehicle status indicator for locally indicating vehicle and owner information. The device also includes a processor having a coder/decoder that decodes the updated information received from the wide area paging network and sends the decoded information to the database. In response to the interrogation receiver receiving the interrogation signal, the processor retrieves the information from the database and sends it to the status indicator.

In yet another aspect, the present invention is a system for remotely updating and locally displaying the status of a vehicle. The system includes a vehicle status device for locally displaying status information for the vehicle when an interrogation signal is received. The status device includes a database of status information for the vehicle; an update receiver that receives updated vehicle information for storage in the database; an interrogation receiver that receives the interrogation signal from an interrogating unit; and a vehicle status indicator for indicating the vehicle status information in response to the interrogation receiver receiving the interrogation signal. The system also includes an interrogating unit comprising an interrogation transmitter for transmitting the interrogation signal to the vehicle status device.

In yet another aspect, the present invention is an electronic vehicle status device for displaying status information for a vehicle. The device includes a wireless Internet access device that requests and receives updated vehicle information from at least one external database that is accessible through the Internet. The device also includes a vehicle status indicator for indicating the vehicle status information, and a processor that receives the vehicle status information from the wireless Internet access device and sends the information to the indicator.

In still yet another aspect, the present invention is a transponder for use in a vehicle having an assigned Internet Protocol (IP) address. The transponder comprises an interrogation receiver that receives an interrogation signal from an interrogating unit, and a response transmitter that transmits the assigned IP address to the interrogating unit. The transponder may be utilized in a system for remotely monitoring the status of the vehicle. In addition to the vehicle transponder, the system includes an interrogating unit that comprises an interrogation transmitter that transmits the interrogation signal to the vehicle transponder, a response receiver that receives the assigned IP address from the vehicle, and a wireless Internet access device that requests and receives updated vehicle status information from at least one external database that is accessible through the Internet.

The vehicle may also include a wireless Internet access device and an internal database for storing vehicle status information. In this case, the interrogating unit may utilize the IP address of the vehicle to retrieve the status information from the internal database in the vehicle, and download the information over the Internet.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The present invention is essentially a remotely updatable vehicle transponder and system. Vehicle and operator status information is downloaded to the vehicle through a wide area paging network. In a first embodiment, when a police unit directs a radar/laser gun toward the vehicle, the system responds by transmitting encoded status information back to the police unit. The vehicle status information is decoded by the police unit and displayed in plain language for the police officer to easily discern the status of the vehicle. In a second embodiment, when a police unit directs a radar/laser gun toward the vehicle, the system responds by displaying the status of the vehicle on an electronic vehicle-status indicator located on the vehicle.

Figure 1:
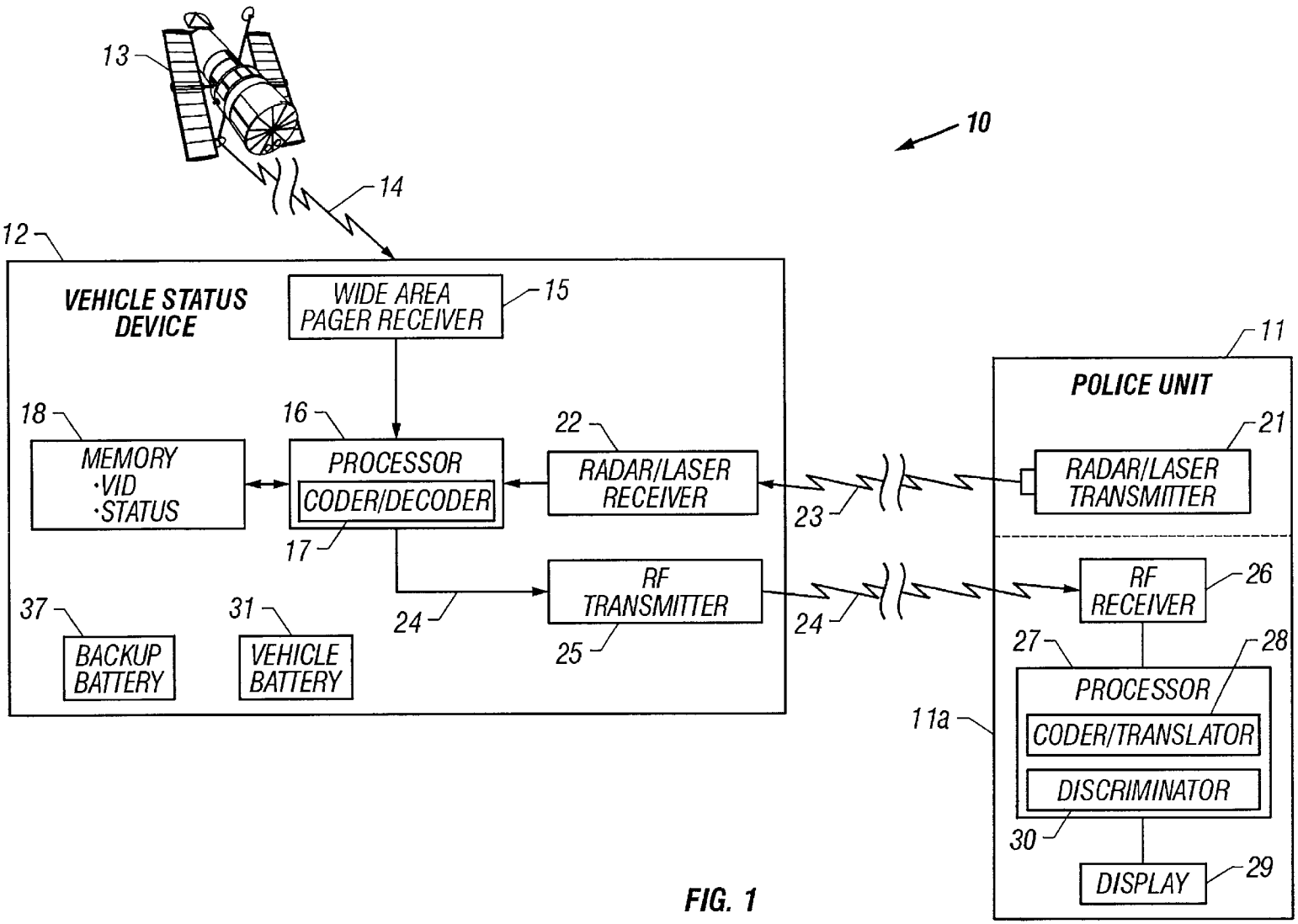
FIG. 1 is a simplified block diagram of a vehicle status device and police unit in a first embodiment of the system of the present invention.

FIG. 1 is a simplified block diagram of the first embodiment of the system of the present invention. The system 10 includes a police unit 11 and a vehicle status device 12. The system may also include a wide area paging network 13 which may be a satellite-based network or a groundbased network such as a cellular network. Updates to the status of the vehicle and/or the operator are communicated from state and local agencies, insurance companies, inspection stations, and/or law enforcement agencies to the wide area paging network. For example, the updates may include, but are not limited to:

- A renewed or expired registration;
- A passed, failed, or out of date safety inspection;
- Inadequate or no liability insurance;
- The identity of the registered owner;
- Whether there are any warrants for the owner;
- Expiration, revocation, or modification of the owner's driver's license, including any newly added restrictions;
- Owner status that is required by law to be reported to local authorities such as convicted sex offender status or convicted felon; and
- Whether the vehicle has been reported as stolen.

The paging network encodes the updated status information and uses the VID of the vehicle to transmit a paging signal with the encoded status information 14 to the vehicle. The information is received in a wide area pager receiver 15. The wide area pager receiver may be a standard wide area pager receiver which passes the encoded status information to a processor 16. The system may optionally be equipped with a page response device (not shown) which transmits a page response to the wide area paging network to confirm that the updated status information was received. The processor includes a coder/decoder 17 which extracts the updated status information from the paging signal. The status information is then stored in a memory device 18 along with the vehicle identification (VID).

The police unit 11 includes a radar/laser transmitter 21 which may be a standard police radar or laser gun normally utilized to determine the speed of a vehicle. The transmitter may operate in standard police bands such as X, K, Ka as well as laser frequencies such as a 904 nanometer laser. When the radar/laser transmitter is directed toward the vehicle status device 12, a radar/laser receiver 22 in the vehicle detects the transmitted signal 23 which acts as an interrogation trigger. The receiver 22 notifies the processor 16 that a trigger has been received. In response, the processor pulls the current status information from memory 18 and uses the coder/decoder 17 to encode the information. The encoded current status information 24 is sent to a radio frequency (RF) transmitter 25 in the vehicle from which it is transmitted back to the police unit. The vehicle status device 12 may require external antennas (not shown) for the radar/laser receiver 22 and the RF transmitter 25 if the device is mounted under the vehicle hood or in some other location where the device is shielded. Omni-directional antennas may be utilized since the direction of the police unit is not known.

The encoded current status information is received by an RF receiver 26 in the police unit. The signal is then sent to a processor 27 where a decoder/translator 28 decodes the status information and uses, for example, a look-up table to provide a plain-language translation of the decoded current status information. The plain-language translation of the current status information is then displayed on a display screen 29 for the police officer to view.

It is possible for several vehicles in close proximity to detect the interrogation trigger from the police unit and transmit a response. Therefore, the processor may also include a discriminator 30 that discriminates between multiple responses and prioritizes the responses. The discriminator may, for example, prioritize the responses so that the most serious infractions or dangerous situations are displayed first to the police officer. For example, a vehicle response indicating that the vehicle has been stolen may be displayed before the response of another vehicle indicating that the safety inspection is overdue.

Although the police unit 11 is depicted in FIG. 1 as a single unit, in practice the components of the police unit may comprise a police radar/laser gun 21 which is separate from a receiving and display unit 11*a*. This potential separation is indicated by the dashed line in FIG. 1. The radar/laser gun may be located in the same police car as the receiving and display unit, or it may be remotely located since no direct connection is required between the radar/laser gun and the receiving and display unit.

In the preferred embodiment, the vehicle status device 12 is powered from the vehicle battery 31. The vehicle status device may be mounted in any suitable container, and may be mounted in any suitable location in the vehicle. For example, the device may be mounted under the hood in an auto-accessory package similar to a fuse box. Alternatively, as shown in the side elevational view of FIG. 2, the vehicle status device may be contained in a cylindrical casing 32 which mounts onto a battery cable 33 from the vehicle battery. The battery cable includes an insulation layer 34 and a conductor 35. Power may be introduced by piercing the battery cable insulation or connecting to the cable connector, and connecting the casing to an external ground 36. In another embodiment, both ends of the casing are sealed to the battery cable in such a manner that any attempt to remove the device results in disabling the vehicle. Antennas and laser targets may be mounted externally in other locations on the vehicle while the electronics are mounted under the hood.

An internal rechargeable backup battery 37 (FIG. 1) is utilized in the vehicle status device 12 to ensure that data is not lost if and while the car battery is disconnected. The backup battery senses power removal and notifies the processor 16. The processor may set the system to a standby mode to conserve battery power, and/or may set a special code to indicate in future interrogation responses that power was lost at some point.

Figure 2:
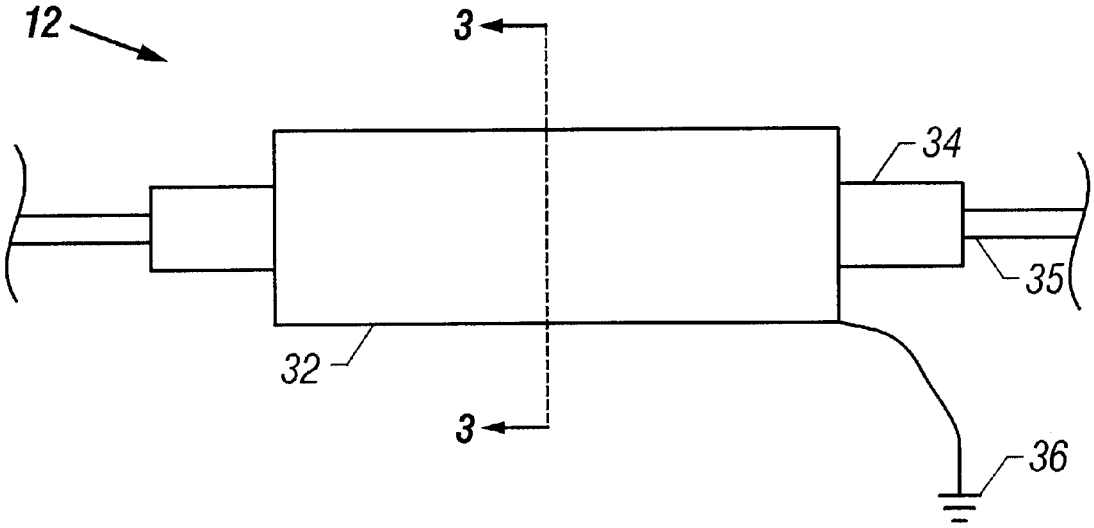
FIG. 2 is a side elevational view of the vehicle status device mounted on a vehicle battery cable.
Figure 3:
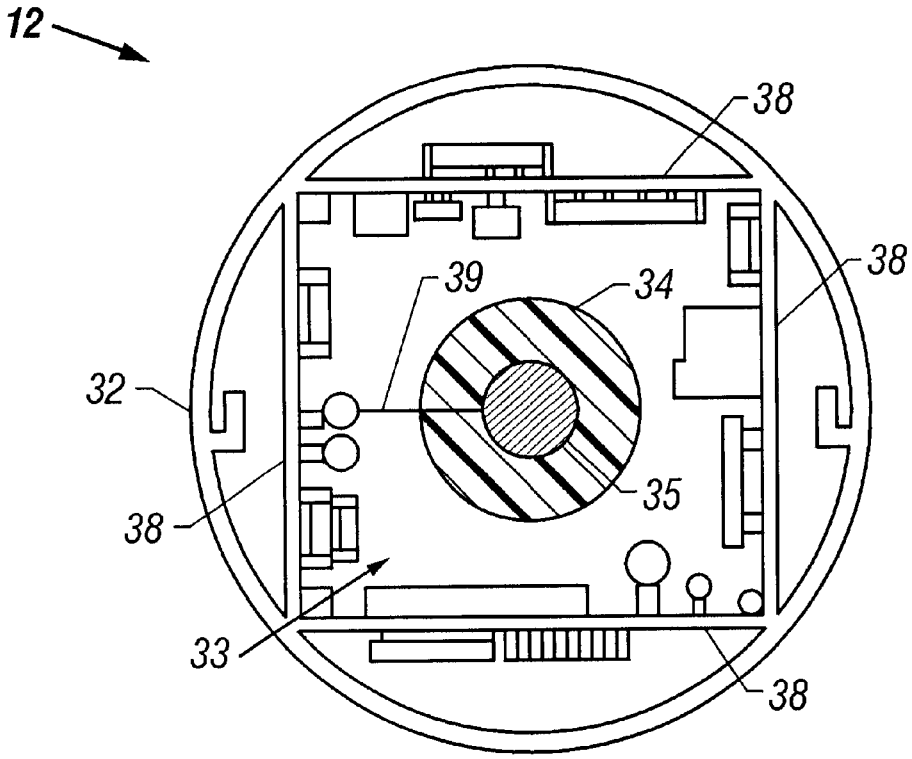
FIG. 3 is a cross sectional view of the vehicle status device taken along line 3—3 of FIG. 2.

FIG. 3 is a cross sectional view of the vehicle status device 12 taken along line 3—3 of FIG. 2. The cylindrical casing 32 surrounds the battery cable 33 from the vehicle battery. A plurality of circuit boards 38 are mounted within the casing and surrounding the battery cable. An electrode 39 pierces the insulation layer 34 of the battery cable and makes contact with the conductor 35.

Figure 4:
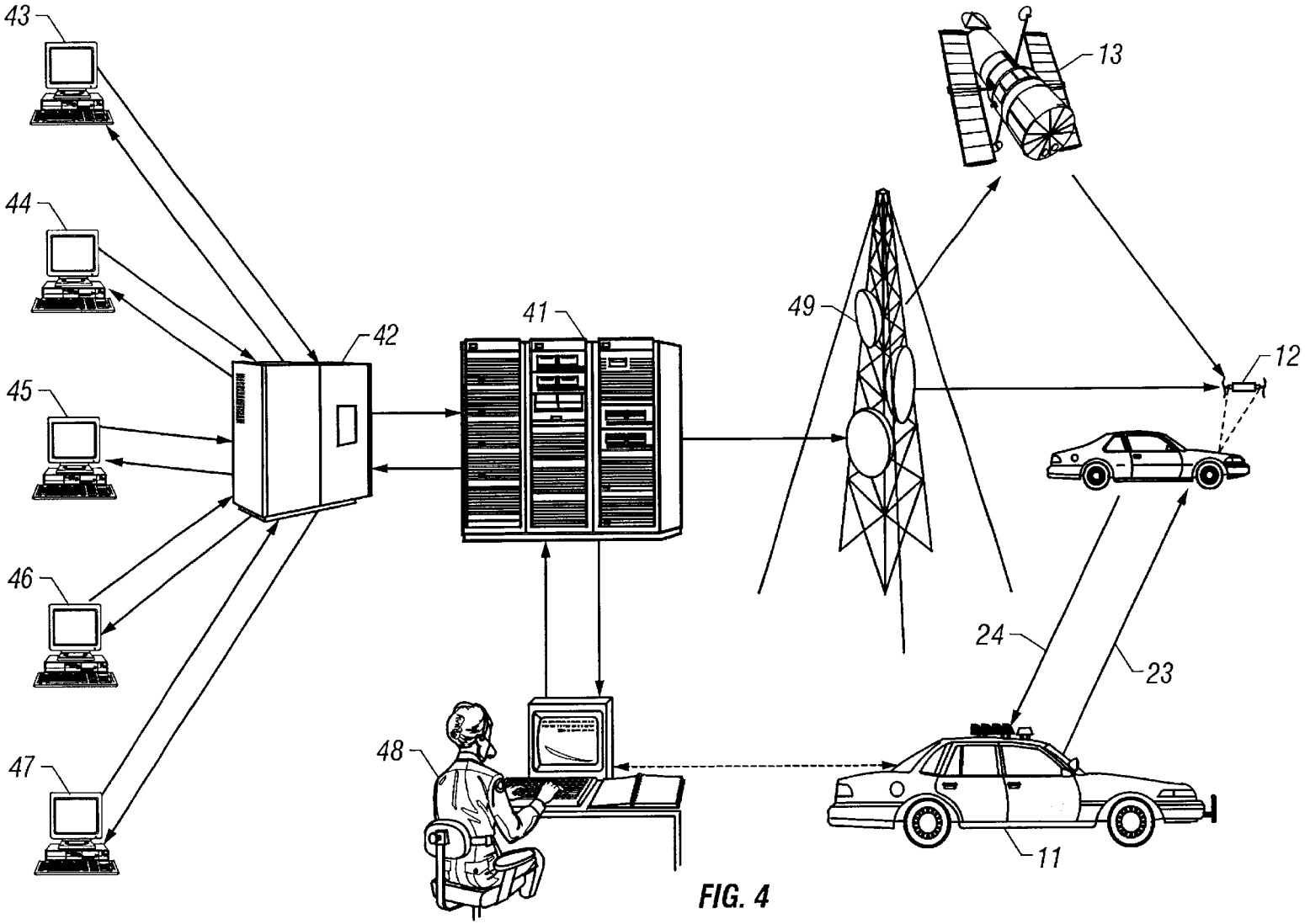
FIG. 4 is a functional block diagram of the system of the present invention in which a data network monitors, processes, and updates vehicle status.

FIG. 4 is a functional block diagram of a data network in which vehicle status is monitored, processed, and updated in accordance with the teachings of the present invention. The network is controlled by a network processor 41 which maintains a central database 42 comprising vehicle status records. The database is populated with vehicle status information and owner information obtained from a plurality of sources. Insurance offices 43 provide information regarding the current status of any automobile insurance policies covering each vehicle in the database. Tax offices 44 provide information regarding the payment of vehicle registration fees and property taxes. Inspection stations 45 provide information regarding state safety inspections on each vehicle in the database. Police departments 46 provide information regarding whether or not the vehicle is stolen, and information about the owner such as any outstanding warrants, felony convictions, etc. Government offices 47 provide information regarding the ownership of the vehicle and other information. Additionally, in one embodiment of the present invention, police departments may help provide emergency messaging services. When someone needs to get an emergency message to a driver, they contact the police department which then updates the database with an indication that the driver has an emergency message. The vehicle status device 12 is then updated, and whenever any police officer radars the driver's vehicle, the police unit receives an indication that the driver has an emergency message. The police can then inform the driver, for example, to phone home.

The various information sources may automatically send data to the central database 42 whenever the data changes, they may periodically update the database, or the central database may periodically query the various information sources in order to keep the data current. Likewise, a system operator 48 may direct that certain data be updated. This may occur, for example, when a police officer obtains a questionable response from a vehicle and asks the system operator for clarification.

Under the control of the network processor 41, data from the central database is sent to a transmitting facility 49 which is part of a wide area paging network. As noted in the description of FIG. 1, the wide area paging network may be a satellite-based network or a ground-based network such as a cellular network. Using the unique ID of each vehicle, the data is transmitted to each vehicle status device 12. Thereafter, when the vehicle status device detects a radar or laser interrogation 23, a response 24 including the status information is transmitted by the vehicle status device's RF transmitter. This information is then decoded and displayed for the police officer.

In addition to the basic function of providing the police with information regarding vehicle registrations, safety inspections, automobile insurance, auto theft, warrants for the owner, and drivers license restrictions for the owner, the present invention may be utilized to perform other useful functions. Emergency messaging has already been described. Additionally, the vehicle status device 12 may provide the response necessary for access to a gated community or other restricted area. Also, businesses in high crime areas, or businesses that are particularly susceptible to crimes in which a vehicle may be involved (such as banks or convenience stores, etc.), may utilize an embodiment of the present invention in which all vehicles visiting the business are routinely interrogated for status information. This information is then recorded, and if a crime is committed, the status information becomes valuable information in the crime investigation.

Additionally, the vehicle status devices in vehicles that carry hazardous materials can be updated with information related to whether a vehicle is currently carrying hazardous material and the nature of the material being carried.

Figure 5:
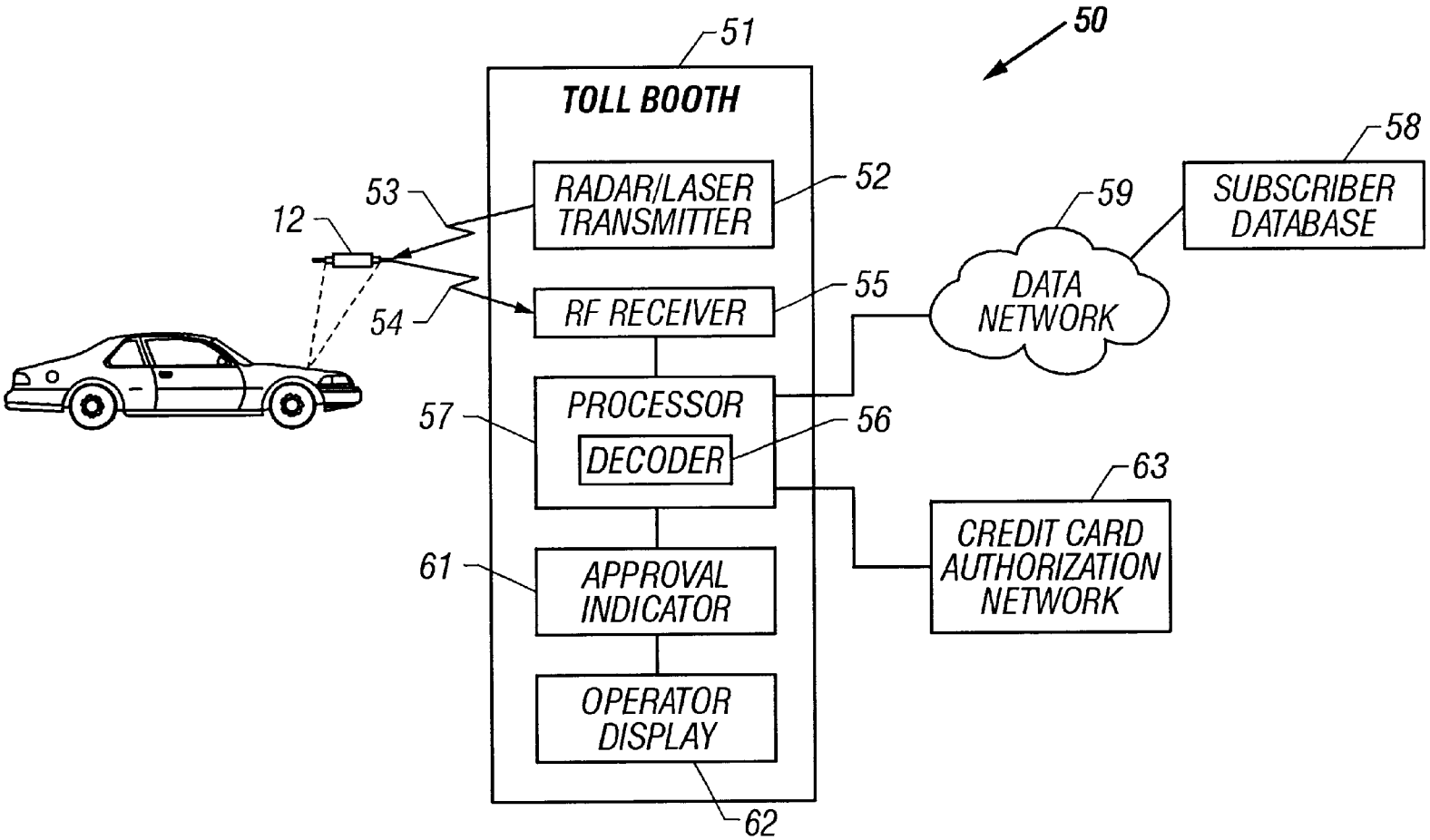
FIG. 5 is a simplified block diagram of a nationwide ticket-less toll system utilizing the vehicle status device and system of the present invention.

The present invention may also be utilized to implement a nationwide ticket-less toll system 50, as illustrated in FIG. 5. Participating vehicle owners can subscribe to the ticket-less toll system by providing confidential credit card information and agreeing to pay all toll charges accrued in the system. The toll system operator may conduct preliminary credit checks at this time. All toll booths such as toll booth 51 are then equipped with a radar/laser transmitter 52 which sends an interrogation signal 53 to each approaching vehicle. The interrogation signal triggers an RF response 54 from the vehicle status device 12 in each approaching vehicle. The RF response contains an identification tag which may be, for example the VID for the vehicle, which can then be matched to an identity of the owner.

The RF response is received by an RF receiver 55 in the toll booth, and is decoded by decoder 56 in a processor 57. The processor compares the VID from the response to a database of subscribers 58. The subscriber database may be located locally at the toll booth or may be remotely located and accessed over a data network 59. The database matches the VID with the subscriber's name, address, credit card information, and an indication of whether the subscriber is currently a valid subscriber. If the VID is for a valid subscriber, the toll booth approves the passage of the vehicle and an indicator 61 (such as a green light) provides the driver with approval to pass through the toll booth without having to stop. An operator display 62 may also provide the toll booth operator with an indication that the vehicle is approved for passage. The ticket-less toll system then charges the owner's credit card for the toll. Credit card transactions may be conducted in non-real time through a credit card authorization network 63. Vehicles that do not respond to the radar/laser interrogation must stop and manually pay the toll.

Since many toll plazas have more than one toll booth, there is a requirement to identify which lane the approaching vehicle is in so that the indication to proceed is provided to the correct vehicle. Adjustments may be made to the sensitivity of the radar/laser receiver 22 and/or to the transmitter power or antenna gain of the radar/laser transmitter 52 so that a response is not triggered from the approaching vehicle until the vehicle is in a particular lane and in close proximity to the toll booth.

The present invention may also be utilized by new car dealers for inventory control. With a laser/radar transmitter and an RF receiver unit similar to the police unit 11 of FIG. 1, the dealer can quickly survey all of the cars on his lot for VIDs and other status information that may be factory programmed into the vehicle status devices 12.

Figure 6:
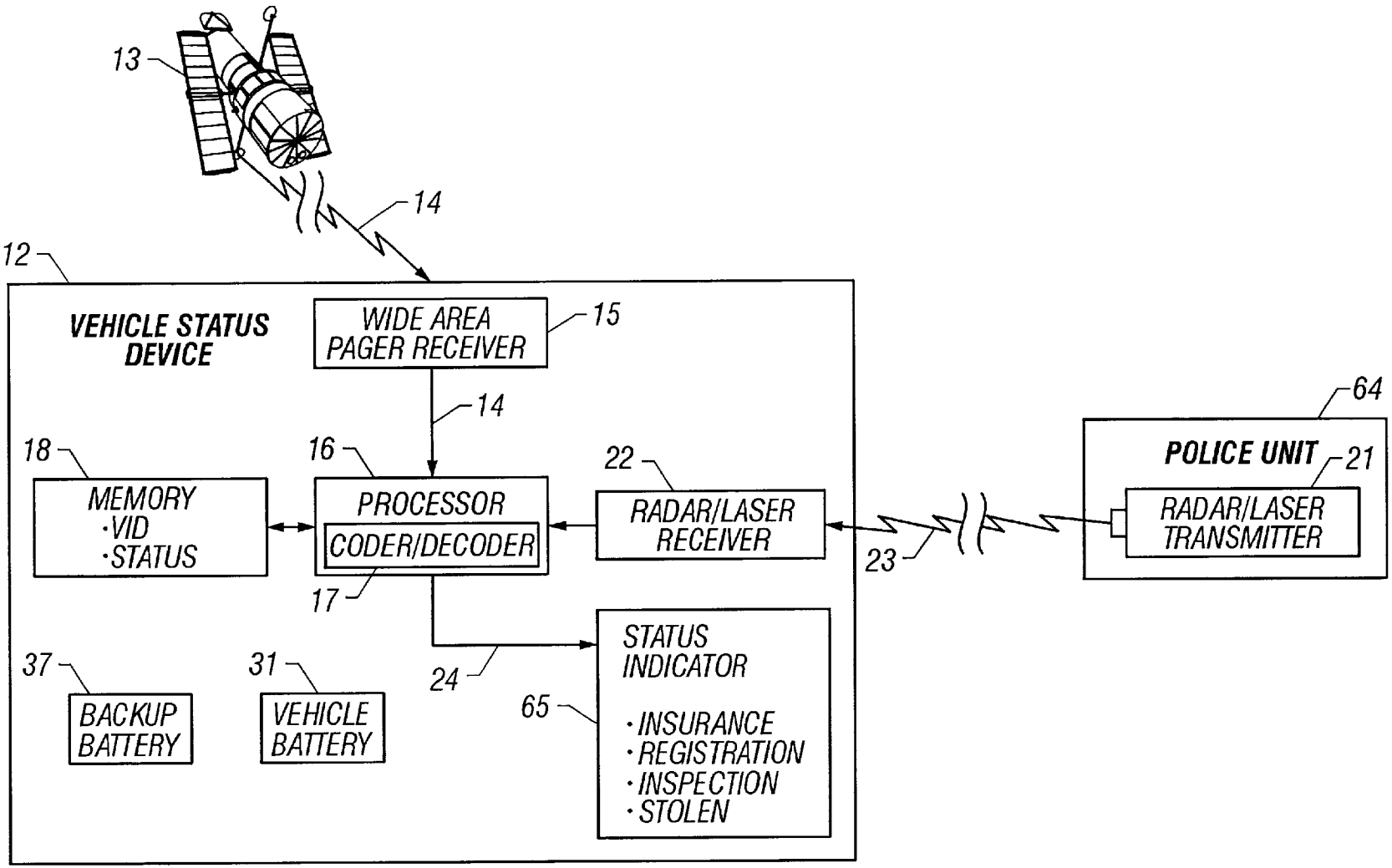
FIG. 6 is a simplified block diagram of a vehicle status device and police unit in a second embodiment of the system of the present invention.

FIG. 6 is a simplified block diagram of a vehicle status device and police unit in a second embodiment of the system of the present invention. In this embodiment, only the radar/laser gun 21 is required in the police unit 64. The vehicle status device 12 includes a vehicle-status indicator 65 which replaces the RF transmitter 25 in the first embodiment. When the radar/laser gun is directed toward the vehicle, the system responds by displaying the status of the vehicle on an electronic vehicle-status indicator 65 located on the vehicle. The indicator is preferably located in an area that is easily visible to a police officer approaching the vehicle. The indicator may utilize a display such as a liquid crystal display (LCD) to provide detailed status information, or it may utilize simple status indicators such as green, yellow and red status panels or lights to indicate a summary status of the vehicle in several areas of interest. The status indicators and the LCD may also be combined, with the status indicators providing a quick summary of the status, and the LCD providing more detailed information when requested.

Figure 7:
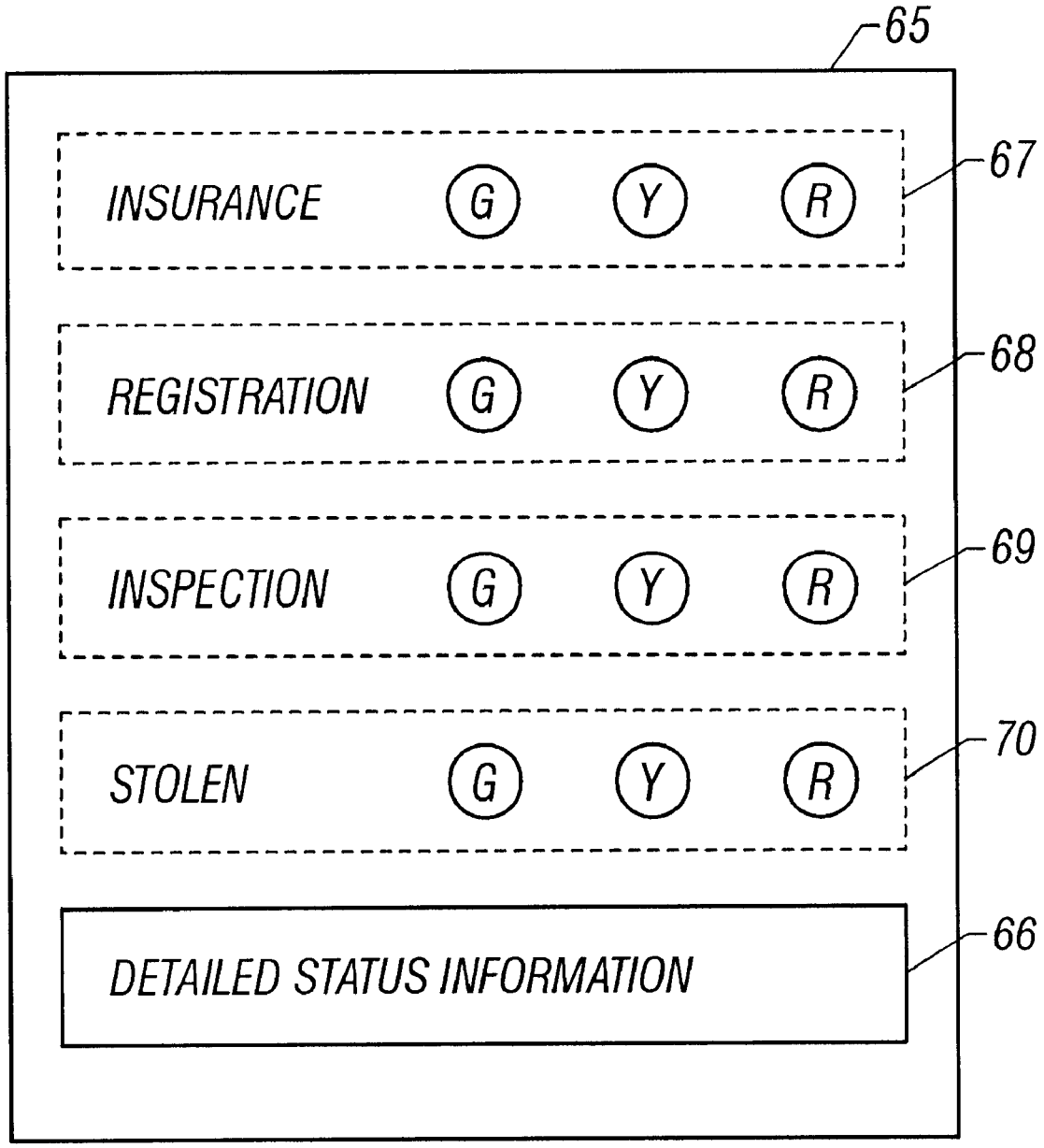
FIG. 7 is an exemplary vehicle-status indicator for use with the system of FIG. 6.

FIG. 7 is an exemplary vehicle-status indicator 65 for use with the system of FIG. 6. This version of the status indicator utilizes simple green, yellow and red status lights to indicate the summary status of the vehicle in several areas of interest. With a green light for each area of interest indicating a good status, a police officer approaching the vehicle can tell at a glance whether a vehicle is "all green", or whether there is a potential problem. An LCD 66 is also provided for displaying more detailed status information.

A first set of indicator lights 67 may show the status of the insurance on the vehicle. If insurance is currently in force at levels that comply with the state law, a green light may be illuminated. If an insurance policy is in force, but some of its provisions do not comply with the state law, a yellow light may be illuminated. If the vehicle is uninsured, a red light may be illuminated.

A second set of indicator lights 68 may show the status of the vehicle registration. If the vehicle is properly registered, a green light may be illuminated. If the vehicle is properly registered, but is within a predetermined period of time of the expiration of the registration, a yellow light may be illuminated. If the vehicle's registration has expired, a red light may be illuminated.

A third set of indicator lights 69 may show the status of the vehicle safety inspection. If the vehicle has passed a state safety inspection, and the inspection is current, a green light may be illuminated. If the vehicle failed a safety inspection, but is operating during a grace period that the state allows for the correction of discrepancies and re-inspection, a yellow light may be illuminated. If the vehicle's safety inspection has expired, a red light may be illuminated.

For each of the above sets of indicator lights, the yellow light may alternatively be used to indicate that the associated information has not been received, or that a scheduled periodic update was missed.

A fourth set of indicator lights 70 may show whether the vehicle has been reported as stolen. If the vehicle has not been reported as stolen, a green light may be illuminated. If the vehicle has been reported as stolen, a red light may be illuminated.

Thus, the electronic vehicle-status indicator 65 essentially replaces the paper versions of the proof-of-insurance, vehicle registration sticker, and safety inspection sticker with an electronic version that is much more reliable. This can save states millions of dollars per year in costs associated with printing, handling and mailing new vehicle stickers. In addition, the status information is more timely since the system is still updated remotely by wide area broadcast. The information is also much more difficult for dishonest drivers to falsify since the information is encoded when it is transmitted to the vehicle. State agencies may periodically change the encoding key and transmit the new key to installed vehicle status devices. New information can then be transmitted, or the vehicle's existing information can be retransmitted, so that any information that has been illegally altered is rewritten with the correct information. The indicator also instantly provides police with the important information that a vehicle has been reported as stolen.

Figure 8:
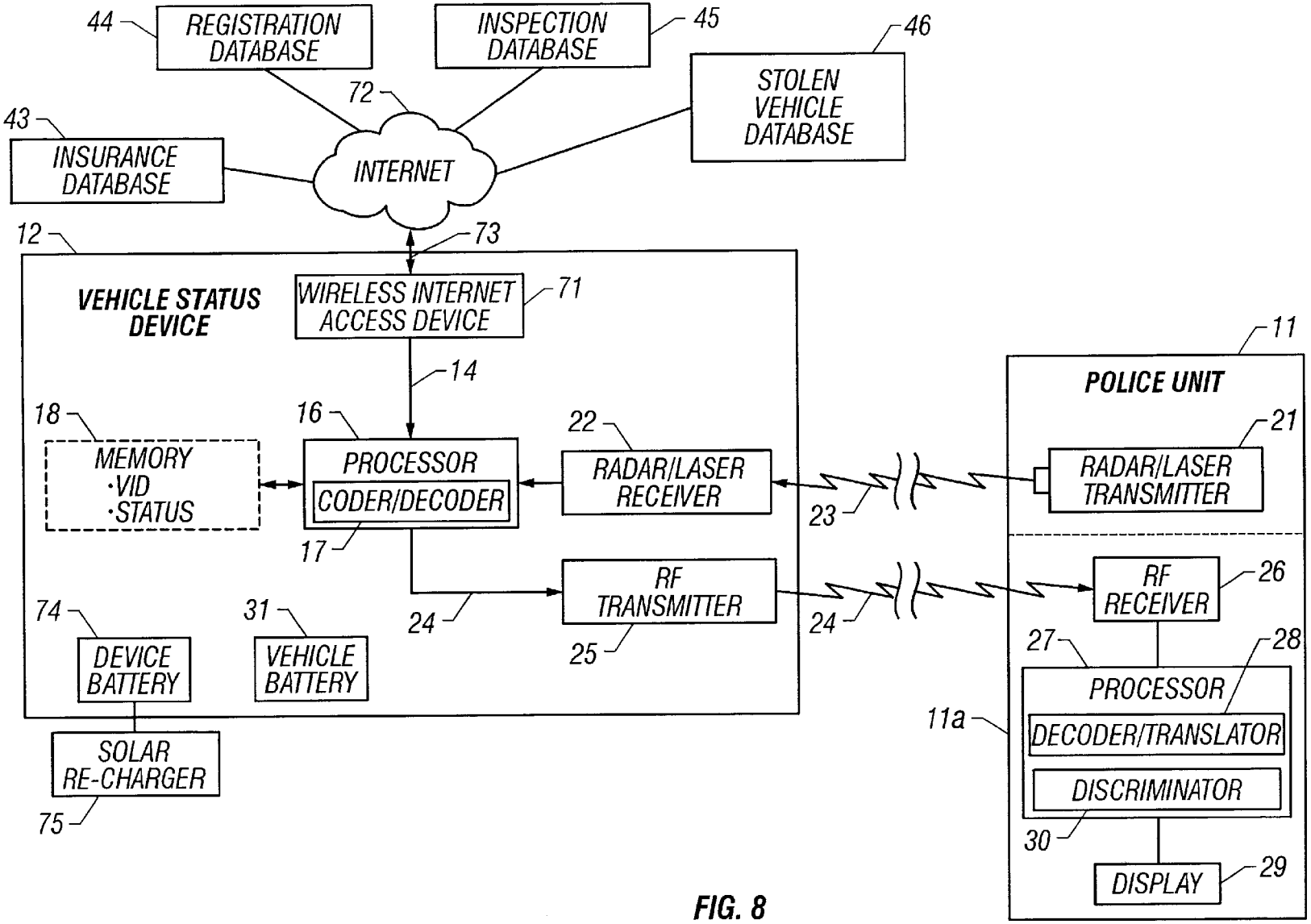
FIG. 8 is a simplified block diagram of a vehicle status device and police unit in a third embodiment of the system of the present invention.

FIG. 8 is a simplified block diagram of a vehicle status device and police unit in a third embodiment of the system of the present invention. In this embodiment, the internal database 18 in the vehicle status device 12 is optional, and may be eliminated. In addition, the wide area pager receiver 15 (FIGS. 1 and 6) is replaced with a wireless Internet access device 71 which connects the vehicle status device to the Internet 72. When the vehicle status device is interrogated by the police unit 11, the device sends status requests 73 through the Internet to access the various databases 43–46 which contain the required vehicle status information. This information is then downloaded to the vehicle status device through the wireless Internet access device 71. The processor 16 then passes the downloaded information optionally to the database 15, or directly to the RF transmitter 25 for transmission to the police unit. In this embodiment, the vehicle status device 12 may operate off of the vehicle battery 31 or a device battery 74 that is dedicated to the status device. The device battery may be a rechargeable battery that is kept charged by a solar-powered re-charger 75.

Figure 9:
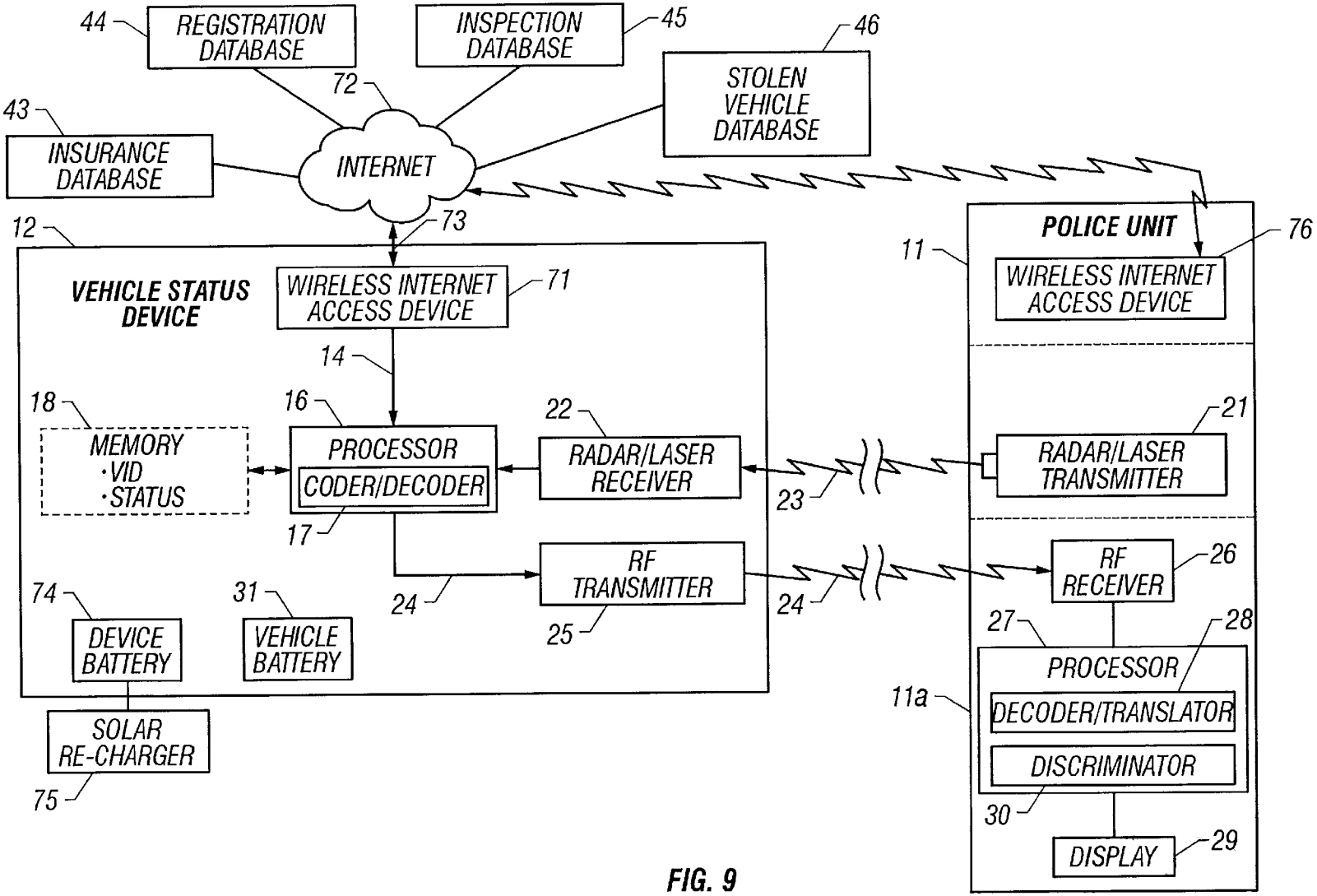
FIG. 9 is a simplified block diagram of a variation of the third embodiment of FIG. 8.

In a variation of this embodiment shown in FIG. 9, when the vehicle status device 12 is interrogated by the police unit 11, the device uses the RF transmitter 25 to transmit an Internet Protocol (IP) address such as a Domain Name Server (DNS) address to the police unit. The police unit includes a wireless Internet access device 76 that enables the police unit to access the vehicle status device via the Internet 72 and retrieve the status information from the internal database 18. The information may then be passed back to the police unit via the Internet 72. Alternatively, the police unit may utilize the DNS address (and a police access code) to access the Internet and download the vehicle status information directly from the external databases 43–46. In this case, the status device merely acts as a transponder by transmitting the DNS address to the police unit in response to receiving the interrogation signal.

Figure 10:
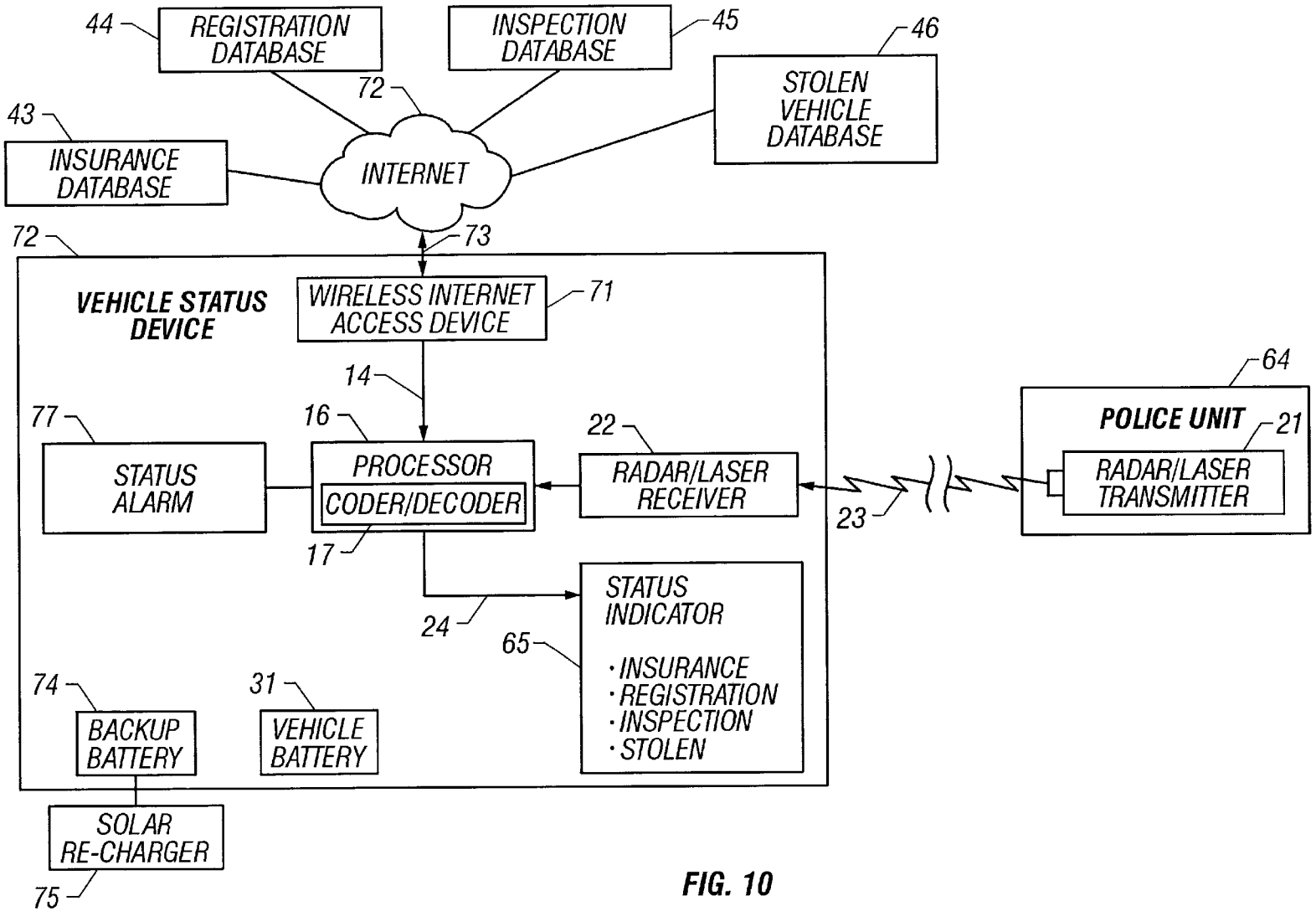
FIG. 10 is a simplified block diagram of a vehicle status device and police unit in a fourth embodiment of the system of the present invention.

FIG. 10 is a simplified block diagram of a vehicle status device and police unit in a fourth embodiment of the system of the present invention. In this embodiment, the internal database 18 is eliminated, and the wide area pager receiver 15 is replaced with the wireless Internet access device 71 which connects the vehicle status device to the Internet 72. The device is always on, and is powered by the vehicle battery 31 or the device battery 74. The device battery may be a rechargeable battery that is kept charged by the solar-powered re-charger 75.

In this configuration, the status indicator 65 shows the last vehicle status that was downloaded from the external databases 43–46 through the Internet 72 and the wireless Internet access device. The processor 16 may be programmed to periodically update this information by sending periodic update requests 73 to the Internet. In this way, both the vehicle owner and the police may visually determine the vehicle status. As an additional feature, a status alarm 77 may be controlled to provide a warning to the vehicle owner if one of the status areas goes "yellow" or "red". The owner can then take corrective action.

The vehicle status may also be updated on demand. When the vehicle status device 12 is interrogated by the police unit 11, the device updates its currently displayed status by sending a status requests 73 through the Internet to access the various databases 43–46 which contain the required vehicle status information. This information is then downloaded to the vehicle status device through the wireless Internet access device 71. The processor 16 then passes the downloaded information to the status indicator 65.

It is thus believed that the operation and construction of the present invention will be apparent from the foregoing description. While the indicator and system shown and described has been characterized as being preferred, it will be readily apparent that various changes and modifications could be made therein without departing from the scope of the invention as defined in the following claims.

What is claimed is:

1. A vehicle status device mounted within a vehicle for displaying status information for the vehicle, said device interfacing with an external central database and an external police radar transmitter, said device comprising:

a control processor, a device memory interfaced with the processor, said memory storing status information for the vehicle;

an update receiver that receives updated vehicle status information from the external central database and passes the information to the processor for storage in the device memory;

a radar receiver that receives a dataless radar signal from the external police radar transmitter and passes an indication of the radar signal to the processor, thereby triggering the processor to retrieve the status information from the device memory; and a vehicle stats indicator mounted on the vehicle for indicating the retrieved vehicle status information;

said processor retrieving the vehicle status information from the device memory and sending the information to the indicator in response to the radar receiver receiving the dataless radar signal.

2. A vehicle status device mounted within a vehicle for displaying status information for the vehicle, said device interfacing with an external central database and an external police laser transmitter, said device comprising:

a control processor;

a device memory interfaced with the processor, said memory storing status information for the vehicle;

an update receiver that receives updated vehicle status information from the external central database and passes the information to the processor for storage in the device memory;

a laser detector that detects a dataless laser signal from the external police laser transmitter and passes an indication of the laser signal to the processor, thereby triggering the processor to retrieve the status information from the device memory; and a vehicle status indicator mounted on the vehicle for indicating the retrieved vehicle status information;

said processor retrieving the vehicle status information from the device memory and sending the information to the indicator in response to the laser detector detecting the dataless laser signal.

3. A vehicle status device mounted within a vehicle for indicating on a status indicator on the vehicle, status information for the vehicle and an owner of the vehicle, said device interfacing with an external central database and an external police radar transmitter, said device comprising:

a control processor;

a device memory interfaced with the processor, said memory storing status information for the vehicle and the owner;

a wide area pager receiver that receives encoded updated vehicle and owner information from the external central database through a wide area paging network, and passes the updated information to the processor for storage in the device memory;

a radar receiver that receives a dataless radar signal from the external police radar transmitter, and passes an indication of the radar signal to the processor for retrieval of the status information from the device memory; and a status indicator on the vehicle for indicating the retrieved vehicle and owner information;

said processor having a coder/decoder that decodes the updated information received from the central database and sends the decoded information to the device memory, and in response to the radar receiver receiving the dataless radar signal, said processor retrieving the information from the device memory and sending it to the indicator.

4. A vehicle status device mounted within a vehicle for indicating on a status indicator on the vehicle, status information for the vehicle and an owner of the vehicle, said device interfacing with an external central database and an external police laser transmitter, said device comprising:

a control processor;

a device memory interfaced with the processor, said memory storing status information for the vehicle and the owner;

a wide area pager receiver that receives encoded updated vehicle and owner information from the external central database through a wide area paging network, and passes the updated information to the processor for storage in the device memory;

a laser detector that detects a dataless laser signal from the external police laser transmitter, and passes an indication of the laser signal to the processor for retrieval of the status information from the device memory; and a status indicator on the vehicle for indicating the retrieved vehicle and owner information;

said processor having a coder/decoder that decodes the updated information received from the central database and sends the decoded information to the device memory, and in response to the laser detector detecting the dataless laser signal, said processor retrieving the information from the device memory and sending it to the indicator.

* * * * *